US009989914B2

(12) United States Patent
Yada et al.

(10) Patent No.: US 9,989,914 B2
(45) Date of Patent: Jun. 5, 2018

(54) CLEANING ROLLER AND CLEANING DEVICE

(71) Applicant: BROTHER KOGYO KABUSHIKI KAISHA, Nagoya-shi, Aichi-ken (JP)

(72) Inventors: Kengo Yada, Seki (JP); Yuichi Matsushita, Nagoya (JP); Keigo Nakajima, Nagoya (JP); Hotaka Kakutani, Kiyosu (JP); Shota Iriyama, Toyokawa (JP); Atsushi Ozawa, Nagakute (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days. days.

(21) Appl. No.: 15/420,358

(22) Filed: Jan. 31, 2017

(65) Prior Publication Data

US 2017/0219988 A1 Aug. 3, 2017

(30) Foreign Application Priority Data

Feb. 2, 2016 (JP) ..... 2016-018290

(51) Int. Cl.
*G03G 21/00* (2006.01)
*G03G 15/02* (2006.01)

(52) U.S. Cl.
CPC ..... *G03G 21/0058* (2013.01); *G03G 15/0225* (2013.01)

(58) Field of Classification Search
CPC ..... G03G 21/0058; G03G 15/0225; G03G 15/0258; G03G 15/161; G03G 2215/1647
USPC ..... 399/100, 176, 357
See application file for complete search history.

(56) References Cited

U.S. PATENT DOCUMENTS

2011/0170896 A1 7/2011 Yamaguchi
2011/0170897 A1* 7/2011 Hagiwara ..... G03G 15/0225 399/100
2011/0170900 A1* 7/2011 Suto ..... G03G 15/0225 399/100
2011/0170901 A1* 7/2011 Kawai ..... G03G 15/0258 399/100
2011/0318047 A1* 12/2011 Nonaka ..... G03G 15/0225 399/100
2014/0037320 A1* 2/2014 Berens ..... G03G 15/0225 399/100
2014/0099141 A1* 4/2014 Nishimura ..... G03G 15/0225 399/100

FOREIGN PATENT DOCUMENTS

JP H08-083030 A 3/1996
JP 2834716 B2 12/1998
(Continued)

OTHER PUBLICATIONS

Related U.S. Appl. No. 15/421,518, filed Feb. 1, 2017.
United States Office Action dated Oct. 24, 2017 received in related U.S. Appl. No. 15/421,518.

*Primary Examiner* — Sophia S Chen
(74) *Attorney, Agent, or Firm* — Scully, Scott, Murphy & Presser, P.C.

(57) ABSTRACT

A cleaning roller including a shaft including a rotational axis extending in an axial direction and an elastic layer covering the shaft. The elastic layer includes a base covering the shaft and a first helical protrusion protruding from the base and having a first helical ridge.

15 Claims, 16 Drawing Sheets

(56) References Cited

FOREIGN PATENT DOCUMENTS

| | | | | |
|---|---|---|---|---|
| JP | 3893225 | B2 | | 3/2007 |
| JP | 2008-096822 | A | | 4/2008 |
| JP | 2011-145411 | A | | 7/2011 |
| JP | 2011-191677 | A | * | 9/2011 |

* cited by examiner

CLEANING ROLLER AND CLEANING DEVICE

CROSS-REFERENCE TO RELATED APPLICATION

This application claims priority from Japanese Patent Application No. 2016-018290, filed on Feb. 2, 2016, which is incorporated herein by reference in its entirety.

TECHNICAL FIELD

The disclosure relates to a cleaning roller and a unit including the cleaning roller for an image forming apparatus.

BACKGROUND

A known image forming apparatus includes a cleaning roller for removing extraneous matter, e.g., residual toner, from a surface of a photosensitive drum or a surface of an intermediate transfer belt.

There has been known a cleaning member for cleaning a charging member for charging an image carrier. The cleaning member includes, for example, a cylindrical core and a foam body disposed on the core in a helical manner.

SUMMARY

Some embodiments of the disclosure provide for a novel cleaning roller and a cleaning device including the cleaning roller.

According to an aspect of the disclosures, there is provided a cleaning roller comprising a shaft including a rotational axis extending in an axial direction and an elastic layer covering the shaft. The elastic layer including a base covering the shaft and a first helical protrusion protruding from the base and having a first helical ridge in a helical manner.

According to another aspect of the disclosures, there is provided a cleaning device for an image forming apparatus comprising a cleaning target and a cleaning roller. The cleaning roller including a shaft and an elastic layer covering the shaft. The elastic layer including a cleaning roller comprising a shaft including a rotational axis extending in an axial direction and an elastic layer covering the shaft. The elastic layer including a base covering the shaft and a first helical protrusion protruding from the base and having a first helical ridge in a helical manner. The cleaning roller being in contact with the cleaning target.

According to the one or more aspects of the disclosure, a novel cleaning roller may be provided including the first helical ridge that extends from the base covering the shaft and has the tapered distal end.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
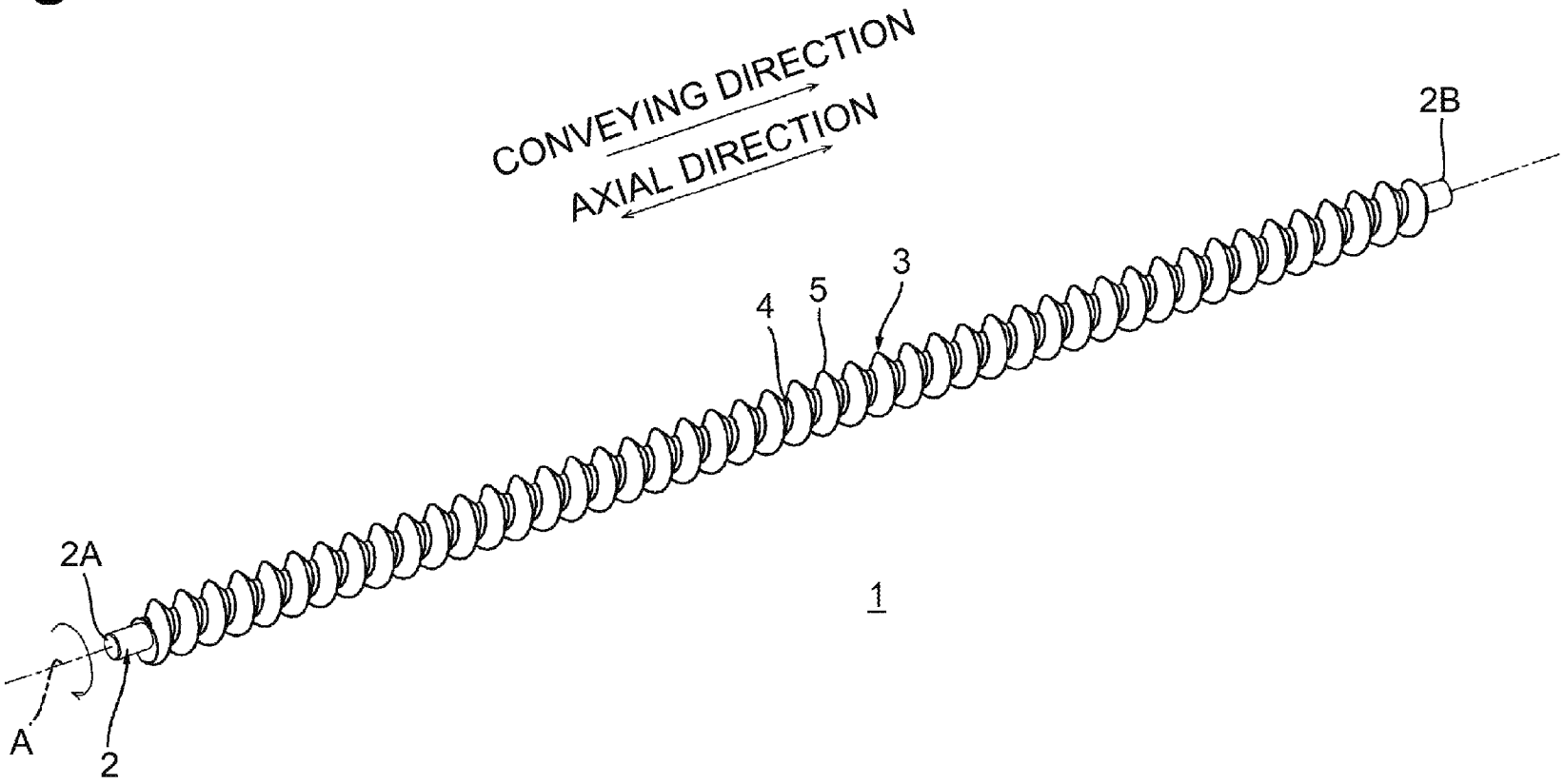
FIG. 1 is a perspective view depicting a cleaning roller in a first illustrative embodiment according to one or more aspects of the disclosure.

Illustrative embodiments will be described in detail with reference to the accompanying drawing, like reference numerals being used for like corresponding parts in the various drawings.

1. Overview of Cleaning Roller 1 According to First Illustrative Embodiment

Referring to FIG. 1, a cleaning roller 1 according to a first illustrative embodiment will be described briefly.

The cleaning roller 1 includes a shaft 2 and an elastic layer 3. In the description below, a direction that an axis A of the shaft 2 extends may be referred to as an axial direction.

The shaft 2 extends along the axial direction. The shaft 2 has a cylindrical shape. The shaft 2 may be made of any material which may ensure stiffness of the cleaning roller 1. For example, the shaft 2 may be made of metallic material, e.g., stainless or iron, or hard resin material. The shaft 2 includes a first end 2A and a second end 2B. The first end 2A may be one of ends of the shaft 2 in the axial direction. The second end 2B may be the other of the ends the shaft 2 in the axial direction and opposite to the first end 2A in the axial direction. The second end 2B is apart from the first end 2A in the axial direction.

The elastic layer 3 is disposed between the first end 2A and the second end 2B in the axial direction. The elastic layer 3 is disposed on a circumferential surface of the shaft 2.

2. Details of Elastic Layer 3

Figure 2:
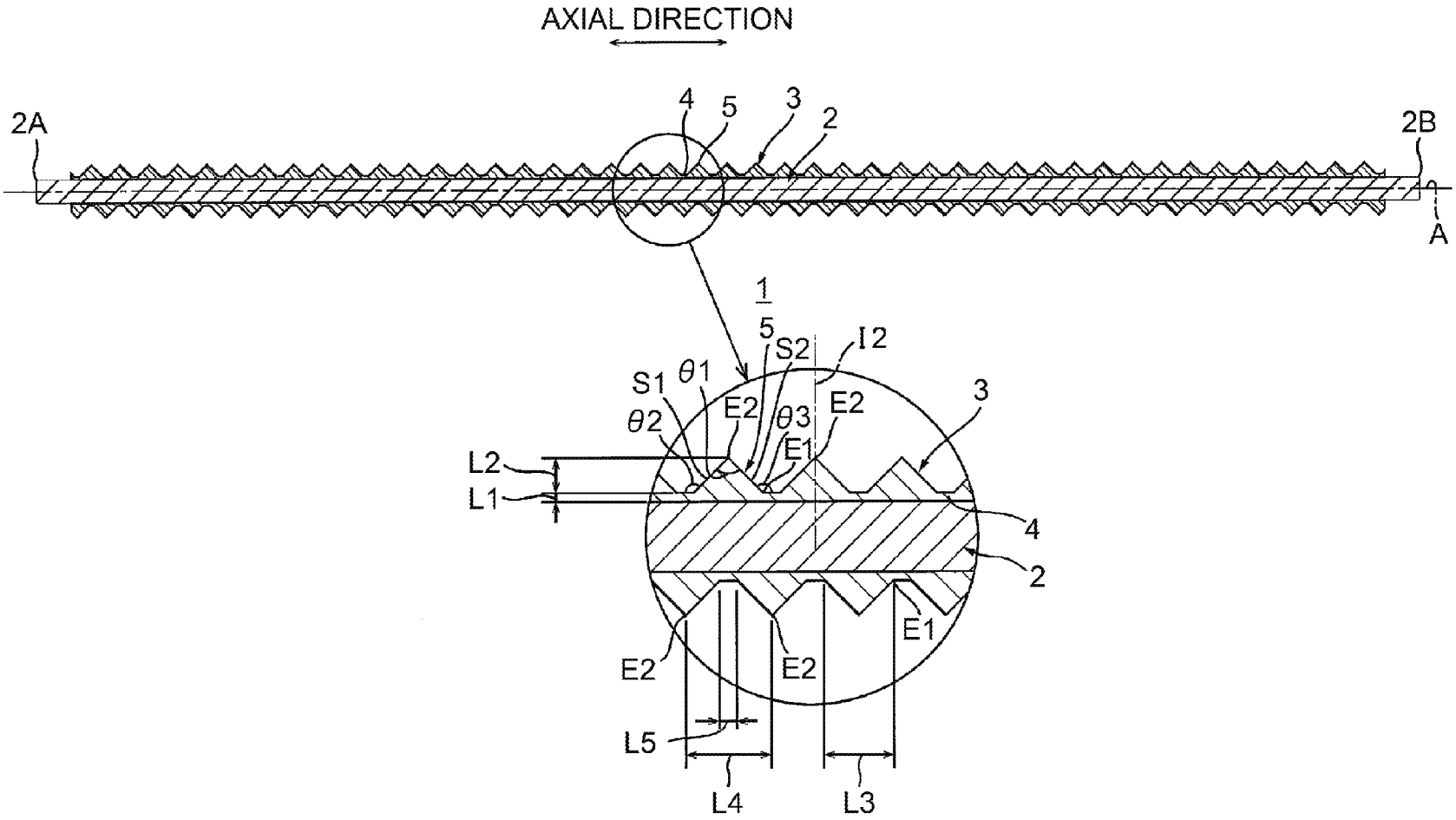
FIG. 2 is a cross-sectional view passing through an axis of a shaft depicting the cleaning roller of FIG. 1 in the first illustrative embodiment according to one or more aspects of the disclosure.

Referring to FIGS. 1 and 2, the elastic layer 3 will be described in detail.

(1) Material for Elastic Layer 3

The elastic layer 3 may be made of any material which may be elastically deformable when the elastic layer 3 contacts with a cleaning target. The elastic layer 3 may be made of, for example, rubber, foam rubber, or thermoplastic elastomer. Rubber or foam rubber includes, for example, urethane, silicon, nitrile rubber, styrene-butadiene rubber, and chloroprene rubber. Thermoplastic elastomer includes, for example, polyester thermoplastic elastomer, polyurethane thermoplastic elastomer, and polybutadiene thermoplastic elastomer. The elastic layer 3 may be made of preferably foam rubber, more preferably urethane foam rubber.

(2) Configuration of Elastic Layer 3

The elastic layer 3 extends along the axial direction. The elastic layer 3 includes a base 4 and a first helical protrusion 5.

(2-1) Base 4

In the elastic layer 3, the base 4 is in contact with the circumferential surface of the shaft 2. The base 4 is positioned between a proximal end E1 of the first helical protrusion 5 and the circumferential surface of the shaft 2. The base 4 is closer to the shaft 2 than the first helical protrusion 5 in a radial direction of the shaft 2. The base 4 extends continuously both along a circumferential direction of the shaft 2 and along the axial direction of the shaft 2. The base 4 covers the shaft 2 continuously both along the circumferential direction of the shaft 2 and along the axial direction of the shaft 2. The base 4 has an exterior surface that extends substantially parallel to the circumferential surface of the shaft 2. The base 4 has a uniform thickness both in the circumferential direction and in the axial direction.

A distance between the circumferential surface of the shaft 2 and the proximal end E1 of the first helical protrusion 5 in the radial direction of the shaft 2 may be referred to as a thickness L1 of the base 4. The thickness L1 of the base 4 may be, for example, 0.2 mm or greater, preferably 0.5 mm or greater, and 5 mm or smaller, preferably 2.5 mm or smaller.

(2-2) First Helical Protrusion 5

(2-2-1) Configuration of First Helical Protrusion 5

The first helical protrusion 5 protrudes from on the base 4 in the radial direction of the shaft 2. The first helical protrusion 5 is positioned farther from the shaft 2 than the base 4 in the radial direction of the shaft 2. The first helical protrusion 5 may extends in a helical manner along the axial direction. The first helical protrusion 5 has a triangular shape in cross section with respect to the axial direction. The rotational axis A is provided on a first imaginary plane I1. The first helical protrusion 5 has a symmetrical shape with respect to a second imaginary plane I2 that intersects the first imaginary plane at a right angle to the axial axis and that passes through the first helical ridge E2. The second imaginary plane I2 extends in the radial direction of the shaft 2 through a point on a first helical ridge E2 of the first helical protrusion 5. The first helical protrusion 5 includes the proximal end E1, the first helical ridge E2, a first surface S1 (as an example of a surface), and a second surface S2 (as another example of the surface).

The proximal end E1 is contiguous with the exterior surface of the base 4. The first helical ridge E2 is farthest from the proximal end E1 in the radial direction of the shaft 2.

The first surface S1 and the second surface S2 are positioned between the proximal end E1 and the first helical ridge E2 in the radial direction of the shaft 2. The first surface S1 and the second surface S2 are opposite to each other relative to the first helical ridge E2 in the axial direction. The first surface S1 is contiguous with one end of the proximal end E1 in the axial direction and the first helical ridge E2. The second surface S2 is contiguous with the other end of the proximal end E1 in the axial direction and the first helical ridge E2. The first surface S1 is inclined toward the second surface S2 in the radial direction as the first surface S1 extends from the proximal end E1 to the first helical ridge E2. The second surface S2 is inclined toward the first surface S1 in the radial direction as the second surface S2 extends from the proximal end E1 to the first helical ridge E2. The first helical protrusion 5 is tapered toward the first helical ridge E2 from the proximal end E1. The first surface S1 and the second surface S2 are connected with each other at the first helical ridge E2. Therefore, the first helical ridge E2 may be a sharp edge. The sharp first helical ridge E2 may include a rounded first helical ridge E2. That is, the sharp first helical ridge E2 may include a chamfered first helical ridge E2. When a first helical ridge E2 is a rounded edge whose radius curvature is 2.0 mm or less, the first helical ridge E2 is determined as a sharp first helical ridge E2. In another example, when a first helical ridge E2 is located within an imaginary circle which touches both an imaginary plane extending from the first surface S1 and an imaginary plane extending from the second surface S2 and has a radius of 2.0 mm, the first helical ridge E2 is determined as a sharp first helical ridge E2. In still another example, when a distance in a height direction of the first helical protrusion 5 between a line formed at an intersection of the imaginary plane extending from the first surface S1 and the imaginary plane extending from the second surface S2 and the first helical ridge E2 is 20% or less of a height L2 of the first helical protrusion 5, the first helical ridge E2 is determined as a sharp first helical ridge E2. In yet another example, when the distance is 0.5 mm or less, the first helical ridge E2 is determined as a sharp first helical ridge E2.

(2-2-2) Dimension of First Helical Protrusion 5

A distance between the proximal end E1 and the first helical ridge E2 in the radial direction of the shaft 2 may be defined as a height L2 of the first helical protrusion 5. The height L2 may be, for example, 0.2 mm or greater, preferably 0.5 mm or greater, and 5 mm or less, preferably 2.5 mm or less.

A width of the proximal end E1 in the axial direction may be defined as a width L3 of the first helical protrusion 5. The width L3 may be, for example, 2.5 mm or greater, preferably 5 mm or greater, and 17.5 mm or less, preferably 15 mm or less.

A distance between crest points of adjacent turns on the first helical ridge E2 in the axial direction may be defined as a pitch L4 of the first helical protrusion 5 (hereinafter, also referred to as a "distal end pitch"). The pitch L4 of the first helical protrusion 5 may be constant. The pitch L4 of the first helical protrusion 5 may be, for example, 5 mm or greater, preferably, 10 mm or greater, and 35 mm or less, preferably, 20 mm or less.

A distance between immediately adjacent end points of adjacent turns on the proximal end E1 in the axial direction may be defined as a pitch L5 of the first helical protrusion 5. The pitch L5 of the first helical protrusion 5 may be constant. The pitch L5 of the first helical protrusion 5 may be, for example, 2.5 mm or greater, preferably, 5 mm or greater, and 17.5 mm or less, preferably, 4.5 mm or less.

An angle θ1 formed by the first surface S1 and the second surface S2 may be, for example, 60° or larger, preferably, 80° or larger, and 120° or smaller, preferably, 100° or smaller.

An angle θ2 formed by the exterior surface of the base 4 and the first surface S1 may be an obtuse angle, which may be, for example, 120° or larger, preferably, 130° or larger, and 150° or smaller, preferably 140° or smaller.

An angle θ3 formed by the exterior surface of the base 4 and the second surface S2 may be an obtuse angle, which may be, for example, 120° or larger, preferably, 130° or larger, and 150° or smaller, preferably, 140° or smaller.

3. Usage of Cleaning Roller 1

Figure 3:
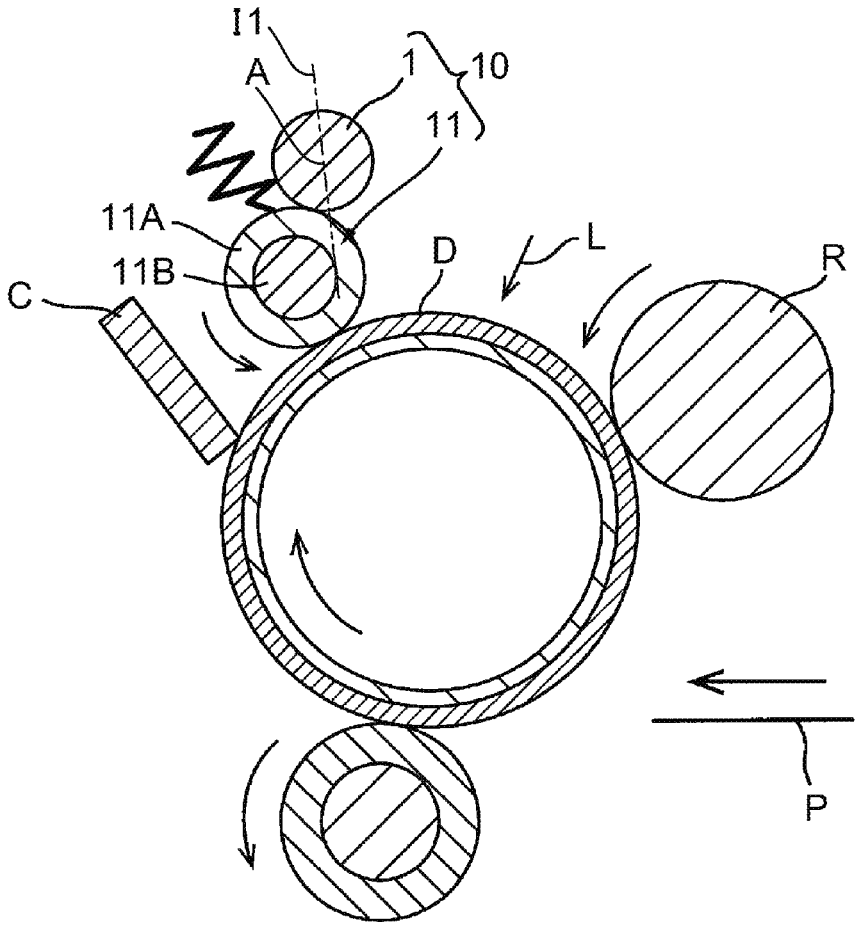
FIG. 3 is an explanatory diagram for explaining usage of the cleaning roller of FIG. 1 in the first illustrative embodiment according to one or more aspects of the disclosure.
Figure 4:
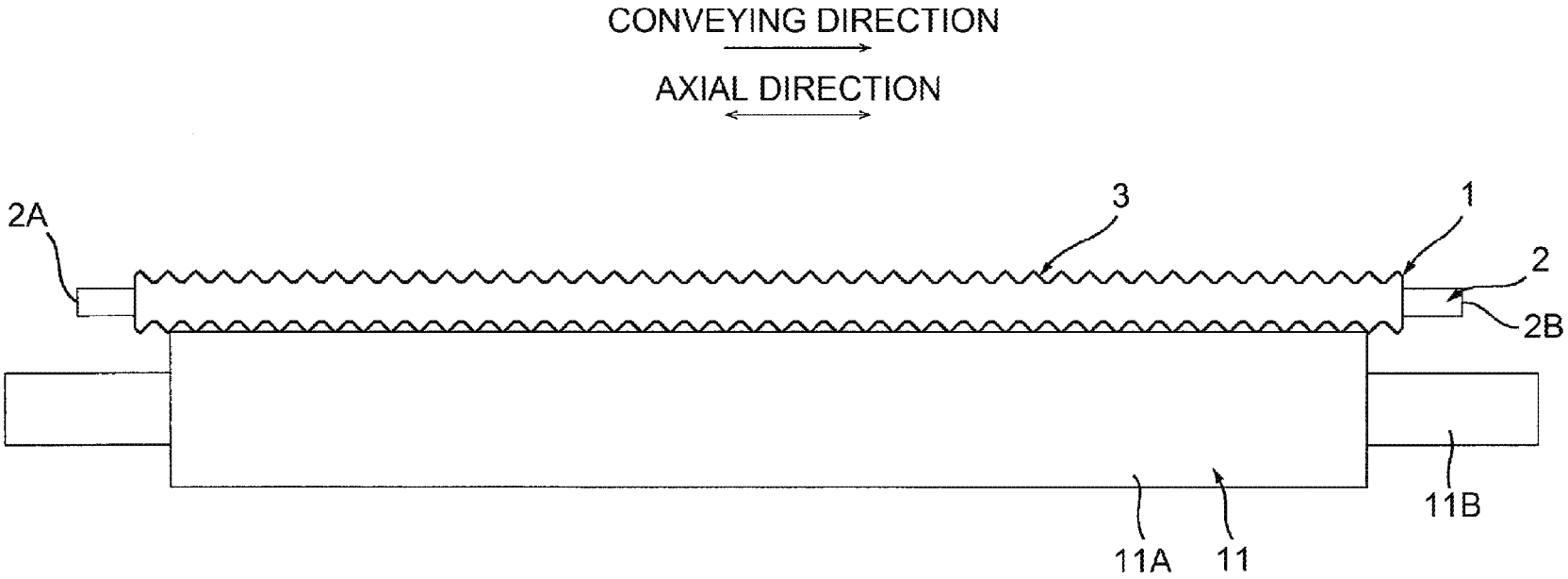
FIG. 4 is an explanatory diagram for explaining a contacting state of a charging roller and the cleaning roller of FIG. 3 in the first illustrative embodiment according to one or more aspects of the disclosure.
Figure 5:
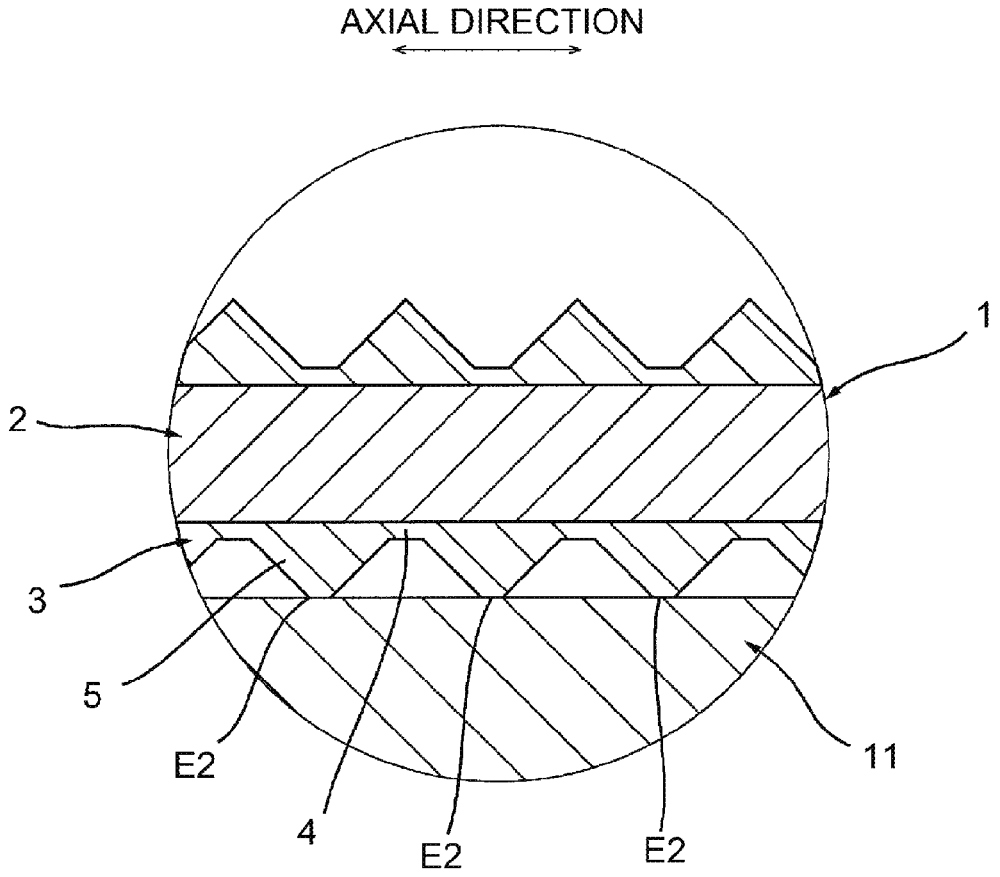
FIG. 5 is a partial enlarged view depicting the contacting state of the charging roller and the cleaning roller of FIG. 3 in the first illustrative embodiment according to one or more aspects of the disclosure, wherein a distal end of a first helical ridge of the cleaning roller is in contact with the charging roller.

Referring to FIGS. 3, 4, and 5, usage of the cleaning roller 1 will be described.

As depicted in FIG. 3, the cleaning roller 1 may be used in, for example, a charging unit 10 (as an example of a unit).

(1) Configuration of Charging Unit 10

The charging unit 10 may be included in an image forming apparatus, and is configured to charge a surface of a photosensitive drum D. The charging unit 10 includes a charging roller 11 and the cleaning roller 1.

As depicted in FIGS. 3 and 4, the charging roller 11 is in contact with the surface of the photosensitive drum D. The charging roller 11 includes a roller portion 11A and a shaft 11B. The roller portion 11A extends in the axial direction. The roller portion 11A has a tubular shape. The roller portion 11A may be made of, for example, conductive resin. The shaft 11B extends in the axial direction. The shaft 11B has a cylindrical shape. The shaft 11B passes through the roller portion 11A in the axial direction. The shaft 11B may be made of metallic material, for example, stainless or iron. The charging roller 11 is configured to charge the surface of the photosensitive drum D by application of a predetermined charging bias to the shaft 11B.

As depicted in FIGS. 4 and 5, the cleaning roller 1 is in contact with a surface of the charging roller 11. The surface of the charging roller 11 is an example of the cleaning target.

In this state, the first helical ridge E2 of the first helical protrusion 5 at a lower side of the cleaning roller 1 is in contact with the surface of the charging roller 11 in the radial direction of the shaft 2. The contacting portion of the first helical ridge E2 of the first helical protrusion 5 is compressed in the radial direction of the shaft 2 by the surface of the charging roller 11. The compression degree of the first helical protrusion 5 may be, for example, 0.1 mm or more, preferably, 0.2 mm or more, and 2.5 mm or less, preferably, 1.0 mm or less. The elastic layer 3 is longer in length along the axial direction than the roller portion 11A of the charging roller 11. The base 4 of the elastic layer 3 is apart from the surface of the charging roller 11 in the radial direction of the shaft 2. The cleaning roller 1 is rotatable by application of a driving force thereto from the image forming apparatus. The compressed portion of the first helical ridge E2 of the first helical protrusion 5 is elastically restored as the compressed portion of the first helical ridge E2 comes separated from the surface of the charging roller 11 in accordance with rotation of the cleaning roller 1.

(2) Function of Cleaning Roller 1

As depicted in FIG. 3, as image formation starts, the charging roller 11 charges the surface of the photosensitive drum D uniformly. Then, an exposure device (not depicted) exposes the surface of the photosensitive drum D with light L. Thus, an electrostatic latent image is formed on the surface of the photosensitive drum D. Thereafter, a developing roller R supplies toner onto the electrostatic latent image. Thus, a toner image is formed on the surface of the photosensitive drum D. The toner image is then transferred onto a sheet P.

After that, a drum cleaner C removes, from the surface of the photosensitive drum D, toner remaining on the surface of the photosensitive drum D after transfer of the toner image (hereinafter, referred to as a "residual toner").

The residual toner which is left out by the drum cleaner C at that time may then adhere to the surface of the charging roller 11.

The cleaning roller 1 removes the residual toner adhering to the surface of the charging roller 11 therefrom. That is, the cleaning roller 1 cleans the surface of the charging roller 11.

As depicted in FIGS. 1 and 4, the first helical protrusion 5 is in a helical shape. Thus, at that time of cleaning the surface of the charging roller 11, the contacting portion of the first helical ridge E2 contacting with the surface of the charging roller 11 shifts in the axial direction in accordance with the rotation of the cleaning roller 1.

Therefore, the residual toner adhering to the surface of the charging roller 11 is scraped therefrom by the first helical ridge E2. More specifically, for example, in a case that the cleaning roller 1 rotates clockwise when viewed from the first end 2A toward the second end 2B of the shaft 2 in the axial direction, the residual toner is conveyed in a direction toward the second end 2B from the first end 2A side of the shaft 2. In the description below, the direction toward the second end 2B from the first end 2A side of the shaft 2 may be referred to as a conveying direction.

3. Effects

As depicted in FIG. 2, the cleaning roller 1 includes the shaft 2 and the elastic layer 3 covering the shaft 2. The elastic layer 3 includes the base 4 covering the shaft 2 and the first helical protrusion 5 extending from the base 4. The first helical protrusion 5 is tapered toward the first helical ridge E2 first helical ridge E2 from the proximal end E1 and the first helical ridge E2 is a sharp edge.

Accordingly, as depicted in FIG. 4, the cleaning roller 1 may remove extraneous matter adhering to the surface of the charging roller 11 therefrom by rubbing the surface of the charging roller 11 along the axial direction with the sharp first helical ridge E2.

4. Variations of First Illustrative Embodiment (1) In one example, the elastic layer 3 may cover an entire portion of the shaft 2 between the first end 2A and the second end 2B in the axial direction.

(2) In another example, the first helical protrusion 5 may be wound without space between turns in the axial direction in the elastic layer 3, i.e., without having the predetermined pitch L5 between turns.

(3) In the first illustrative embodiment, the cleaning roller 1 is used for cleaning the charging roller 11. Nevertheless, in other embodiments, for example, the cleaning roller 1 may be used for cleaning a photosensitive drum or an intermediate transfer belt. In a case that the cleaning roller 1 is used for cleaning the photosensitive drum, for example, a drum cartridge or a drum unit may be an example of the unit. In a case that the cleaning roller 1 is used for cleaning the intermediate transfer belt, for example, an intermediate transfer unit may be an example of the unit.

3. Cleaning Roller 20 According to Second Illustrative Embodiment

Figure 6A:
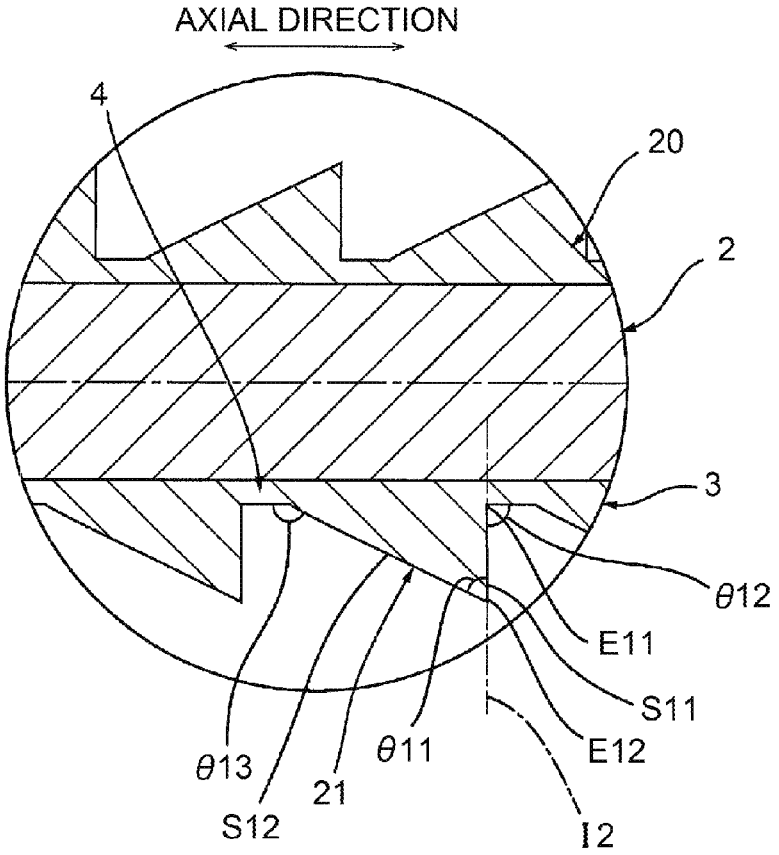
FIG. 6A is a partial enlarged view depicting a first helical ridge of a cleaning roller in a second illustrative embodiment according to one or more aspects of the disclosure.
Figure 6B:
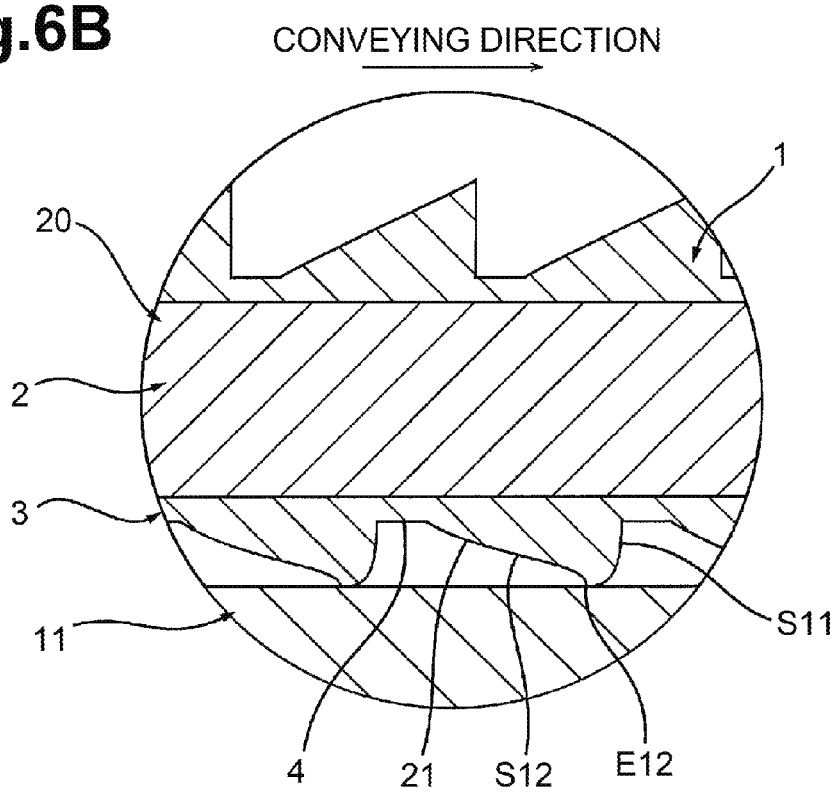
FIG. 6B is a partial enlarged view depicting a contacting state of the charging roller and a helical ridge of the first helical ridge of the cleaning roller of FIG. 6A in the second illustrative embodiment according to one or more aspects of the disclosure.

Referring to FIGS. 6A and 6B, a cleaning roller 20 according to a second illustrative embodiment will be described. An explanation will be given mainly for the parts different from the first illustrative embodiment, and an explanation will be omitted for the common parts by assigning the same or similar reference numerals thereto.

In the second illustrative embodiment, the cleaning roller 20 includes a first helical ridge 21 having a different shape from the first helical protrusion 5 of the cleaning roller 1 while the cleaning roller 20 has a similar configuration to the cleaning roller 1 according to the first illustrative embodiment.

(1) Shape of First Helical Ridge 21

As depicted in FIG. 6A, the first helical ridge 21 has a right triangular shape in cross section with respect to the axial direction.

In the first helical ridge 21, a crest point on a distal end E12 is aligned with one end of a proximal end E11 in the axial direction. The first helical ridge 21 has a nonsymmetrical shape with respect to an imaginary plane I2 in the axial direction. The imaginary plane I2 extends in the radial direction of the shaft 2 through a point on the distal end E12.

A first surface S11 is positioned opposite to a second surface S12 relative to the distal end E12 in the axial direction. The first surface S11 is closer to the second end 2B than the second surface S12 in the direction toward the second end 2B from the first end 2A side of the shaft 2. The first surface S11 extends along the radial direction of the shaft 2. The second surface S12 is inclined toward the first surface S11 in the radial direction of the shaft 2 as the second surface S12 extends from the proximal end E11 to the distal end E12. That is, the first helical ridge 21 is tapered toward the distal end E12 from the proximal end E11. The first surface S11 and the second surface S12 are connected with each other at the distal end E12. Therefore, the distal end E12 may be a sharp edge.

An angle θ11 formed by the first surface S11 and the second surface S12 may be, for example, 45° or larger, preferably, 55° or larger, and 75° or smaller, preferably, 65° or smaller.

An angle θ12 formed by the exterior surface of the base 4 and the first surface S11 may be substantially a right angle.

An angle θ13 formed by the exterior surface of the base 4 and the second surface S12 may be an obtuse angle, which may be, for example, 135° or larger, preferably, 145° or larger, and 165° or smaller, preferably, 155° or smaller.

(2) Effects Obtained by Second Illustrative Embodiment

In the second illustrative embodiment, as depicted in FIG. 6B, when the first helical ridge 21 contacts with the cleaning target, the first helical ridge 21 is deformed such that the contacting portion of the distal end E12 is warped in a direction toward the first end 2A from the second end 2B side of the shaft 2, i.e., in a direction opposite to the conveying direction, with respect to the axial direction. The warped portion of the first helical ridge 21 has resilience acting in the direction toward the first end 2A from the second end 2B side of the shaft 2, i.e., in the conveying direction, with respect to the axial direction.

This resilience may ensure that the first helical ridge 21 surely conveys, along the conveying direction, extraneous matter adhering to the cleaning target, with respect to the axial direction.

According to the second illustrative embodiment, the same effects as those obtained by the first illustrative embodiment may be obtained.

(3) Variation of Second Illustrative Embodiment

In one example, the first helical ridge 21 may have any shape having a sharp distal end.

Figure 7:
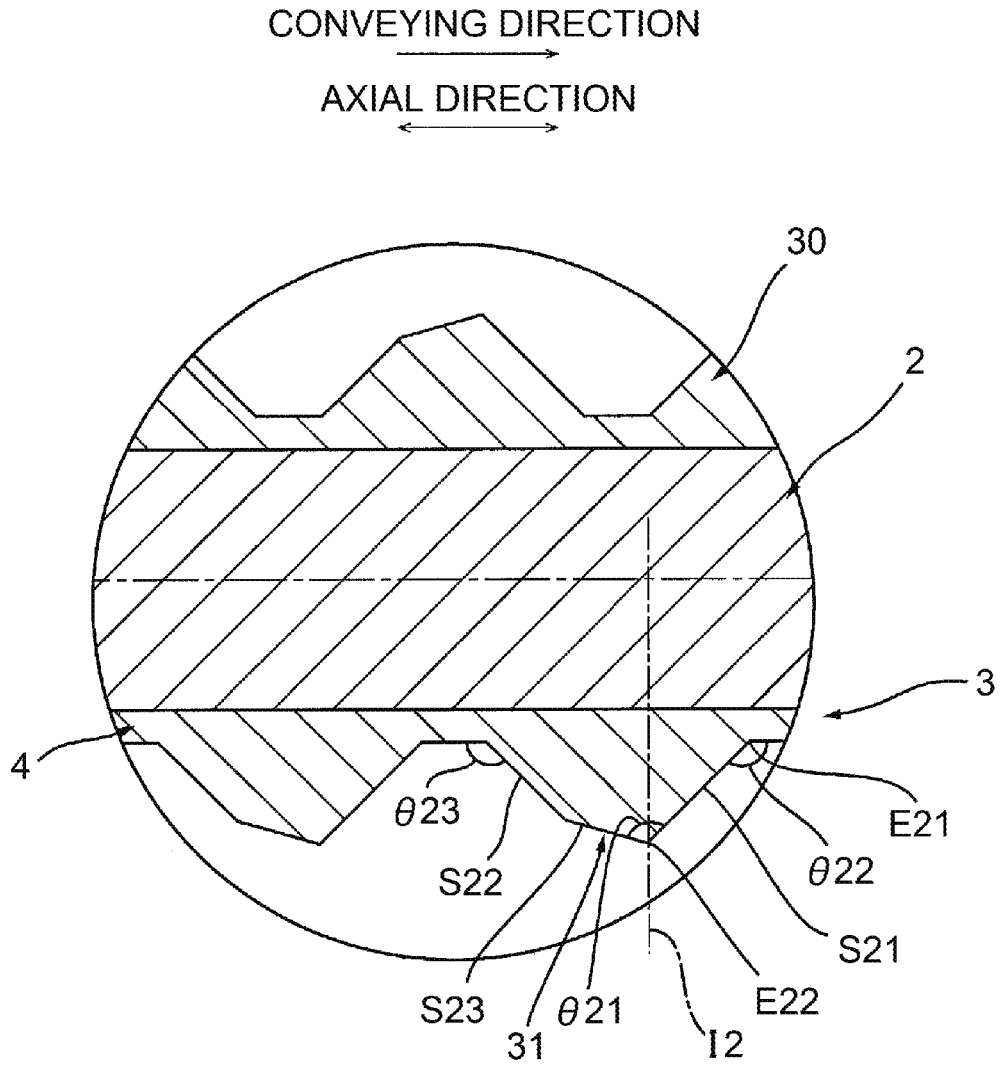
FIG. 7 is an explanatory diagram for explaining a first helical ridge in a variation of the second illustrative embodiment according to one or more aspects of the disclosure.

For example, as depicted in FIG. 7, a cleaning roller 30 according to a variation of the second illustrative embodiment includes a first helical ridge 31 having a different shape from the first helical ridge 21 according to the second illustrative embodiment.

The first helical ridge 31 has a quadrilateral shape in cross section with respect to the axial direction. The first helical ridge 31 includes a first surface S21, a second surface S22, and a third surface S23 between a proximal end E21 and a first helical ridge E22.

The first surface S21 and the second surface S22 are opposite to each other relative to the first helical ridge E22 in the axial direction. The first surface S21 is closer to the second end 2B than the second surface S22 in the direction from the second end 2B toward the first end 2A of the shaft 2. The first surface S21 is contiguous with one end of the proximal end E21 in the axial direction and the first helical ridge E22. The second surface S22 is contiguous with the other end of the proximal end E21 in the axial direction. The second surface S22 is distant from the first helical ridge E22 both in the axial direction and in the radial direction. The first surface S21 is inclined toward the second surface S22 as the first surface S21 extends from the proximal end E21 to the first helical ridge E22 in the radial direction. The second surface S22 is inclined toward the first surface S21 as the second surface S22 extends from the proximal end E21 to the first helical ridge E22 in the radial direction. That is, the first helical ridge 31 is tapered toward the first helical ridge E22 from the proximal end E21.

The third surface S23 is positioned between the first surface S21 and the first helical ridge E22 with respect to the axial direction and the radial direction. The third surface S23 is inclined toward the second surface S22 as the third surface S23 extends from the proximal end E21 to the first helical ridge E22 in the radial direction. The third surface S23 and the second surface S22 are connected with each other at the first helical ridge E22. Therefore, the first helical ridge E22 may be a sharp edge.

An angle θ21 formed by the first surface S21 and the third surface S23 may be, for example, 60° or larger, preferably, 80° or larger, and 120° or smaller, preferably, 100° or smaller.

An angle θ22 formed by the exterior surface of the base 4 and the first surface S21 may be an obtuse angle, which may be, for example, 120° or larger, preferably, 130° or larger, and 150° or smaller, preferably, 140° or smaller.

An angle θ23 formed by the exterior surface of the base 4 and the second surface S22 may be an obtuse angle, which may be, for example, 120° or larger, preferably, 130° or larger, and 150° or smaller, preferably, 140° or smaller.

According to the variation of the second illustrative embodiment, the same effects as those obtained by the second illustrative embodiment may be obtained.

4. Cleaning Roller 40 According to Third Illustrative Embodiment

Figure 8:
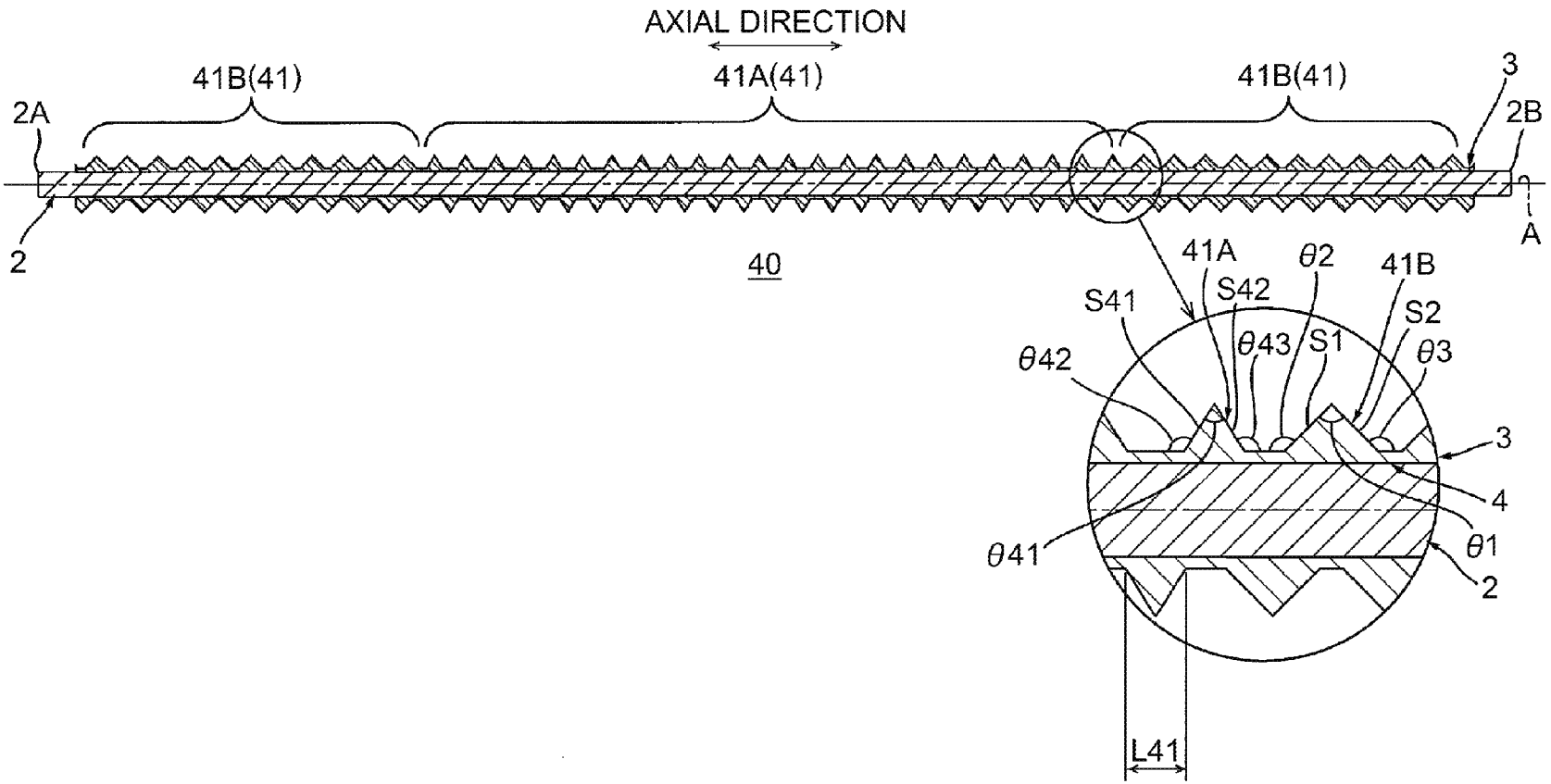
FIG. 8 is a cross-sectional view depicting a cleaning roller in a third illustrative embodiment according to one or more aspects of the disclosure.

Referring to FIG. 8, a cleaning roller 40 according to a third illustrative embodiment will be described. An explanation will be given mainly for the parts different from the first illustrative embodiment, and an explanation will be omitted for the common parts by assigning the same or similar reference numerals thereto.

In the third illustrative embodiment, the cleaning roller 40 includes a first helical ridge 41 having different shapes at different locations, e.g., a central portion and end portions, in the axial direction while the cleaning roller 40 has a similar configuration to the cleaning roller 1 according to the first illustrative embodiment.

(1) Shape of First Helical Ridge 41

The first helical ridge 41 includes a first portion 41A and a second portion 41B. In the cleaning roller 40 according to the third illustrative embodiment, a ridge pitch in the first portion 41A and a ridge pitch in the second portion 41B may be equal to the ridge pitch (e.g., the pitch L4) in the first helical protrusion 5 of the cleaning roller 1 according to the first illustrative embodiment.

The first helical ridge 41 has the first portion 41A at its central portion in the axial direction. While the first portion 41A has the same or similar shape to the first helical protrusion 5 according to the first illustrative embodiment, the first portion 41A has a width narrower than the width of the first helical protrusion 5 according to the first illustrative embodiment.

That is, the first portion 41A has a width L41, which is narrower than the width L3 of the first helical protrusion 5. An angle θ41 formed by a first surface S41 and a second surface S42 of the first portion 41A is smaller than an angle θ1 formed by a first surface S1 and a second surface S2 of the second portion 41B.

An angle θ42 formed by the exterior surface of the base 4 and the first surface S41 may be an obtuse angle, which is smaller than an angle θ2 formed by the exterior surface of the base 4 and the first surface S1 of the second portion 41B.

An angle θ43 formed by the exterior surface of the base 4 and the second surface S42 may be an obtuse angle, which is smaller than an angle θ3 formed by the exterior surface of the base 4 and the second surface S2 of the second portion 41B.

The first helical ridge 41 has the second portion 41B at each side of the first portion 41A (e.g., at each of the end portions of the first helical ridge 41) in the axial direction. The second portion 41B has the same shape as the first helical protrusion 5 according to the first illustrative embodiment. That is, the second portion 41B has a width greater than the width of the first portion 41A, and has a shape different from the shape of the first portion 41A. The second portion 41B has a cross sectional area larger than a cross sectional area of the first portion 41A.

(2) Effects Obtained by Third Illustrative Embodiment

According to the third illustrative embodiment, the same effects as those obtained by the first illustrative embodiment may be obtained.

(3) Variations of Third Illustrative Embodiment (3-1) First Variation

Figure 9:
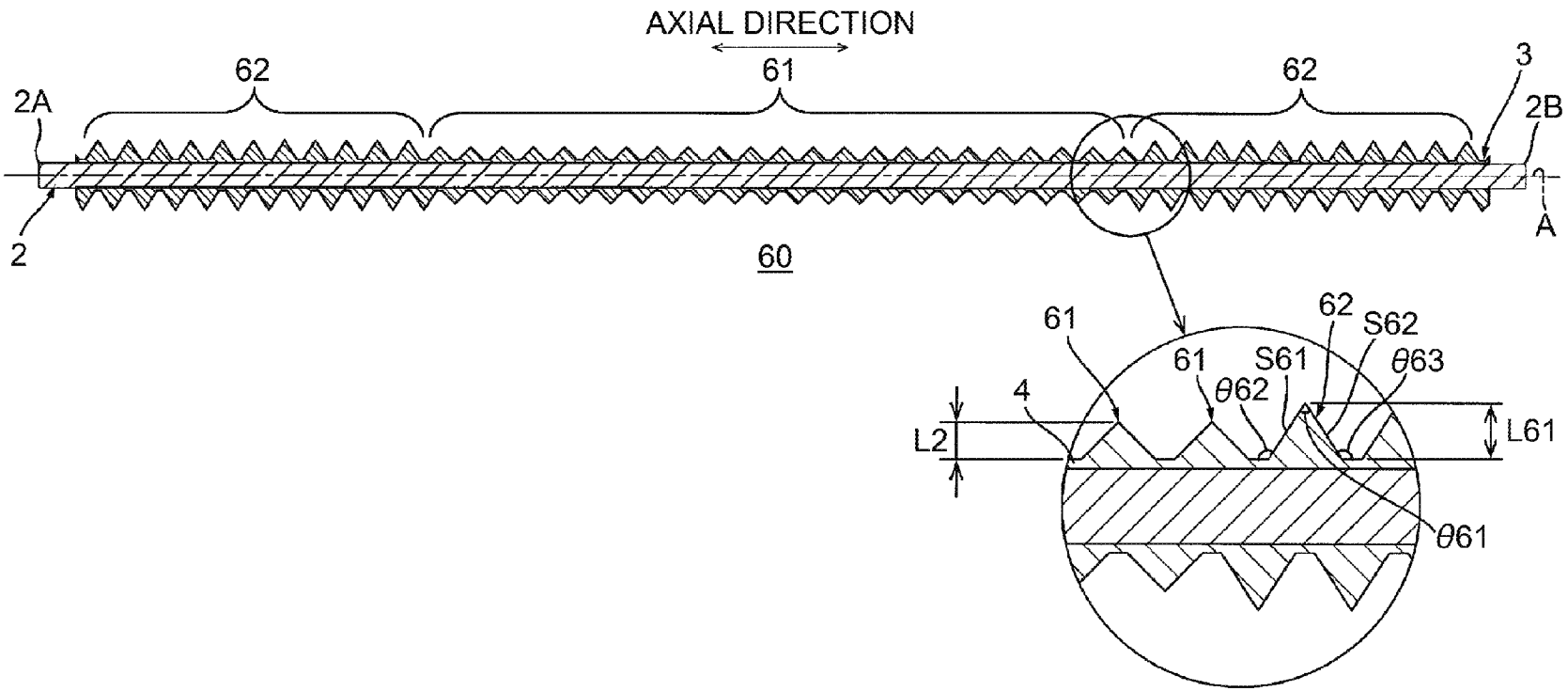
FIG. 9 is a cross-sectional view passing through the axis of the shaft depicting a cleaning roller in a first variation of the third illustrative embodiment according to one or more aspects of the disclosure.

In a first variation of the third illustrative embodiment, as depicted in FIG. 9, for example, a cleaning roller 60 includes a first portion 61 and a second portion 62. The first portion 61 has the same shape as the shape of the first helical protrusion 5 according to the first illustrative embodiment. The second portion 62 has a height greater than the height of the first helical protrusion 5 according to the first illustrative embodiment.

The cleaning roller 60 has the second portion 62 at each side of the first portion 61 in the axial direction. The second portion 62 has a height L61 greater than a height L2 of the first portion 61. That is, the second portion 62 has a different shape from the first portion 61. The second portion 62 has a cross sectional area larger than a cross sectional area of the first portion 61.

An angle θ61 formed by a first surface S61 and a second surface S62 of the second portion 62 may be, for example, 60° or larger, preferably, 80° or larger, and 120° or smaller, preferably, 100° or smaller.

An angle θ62 formed by the exterior surface of the base 4 and the first surface S61 of the second portion 62 may be an obtuse angle, which may be, for example, 120° or larger, preferably, 130° or larger, and 150° or smaller, preferably, 140° or smaller.

An angle θ63 formed by the exterior surface of the base 4 and the second surface S62 of the second portion 62 may be an obtuse angle, which may be, for example, 120° or larger, preferably, 130° or larger, and 150° or smaller, preferably, 140° or smaller.

In the first variation of the third illustrative embodiment, the compression degree of the second portion 62 may be greater than the compression degree of the first portion 61. In other words, the second portion 62 are compressed greater than the first portion 61 in the radial direction of the shaft 2.

(3-2) Second Variation

Figure 10:
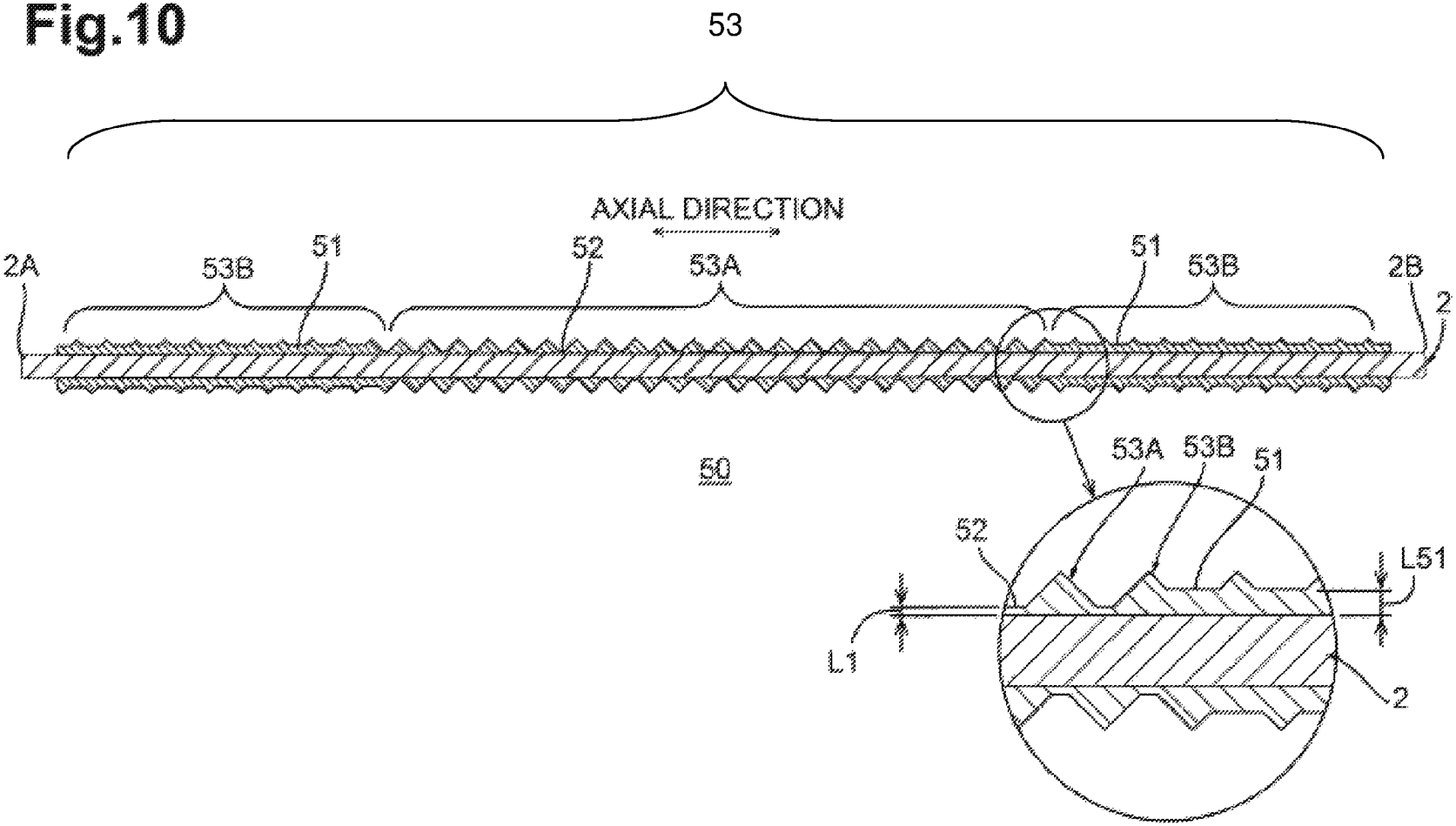
FIG. 10 is a cross-sectional view passing through the axis of the shaft depicting a cleaning roller in a second variation of the third illustrative embodiment according to one or more aspects of the disclosure.

In a second variation of the third illustrative embodiment, as depicted in FIG. 10, a cleaning roller 50 includes base portions 51 and 52 having respective different thicknesses. The cleaning roller 50 has the base portion 51 at each of end portions of the cleaning roller 50, and has the base portion 52 at a central portion of the cleaning roller 50. The end base portions 51 in the axial direction have a thickness L51 greater than a thickness L1 of the central base portion 52. The central base portion 52 has the same shape as the base 4 according to the first illustrative embodiment.

[In the second variation, since the thickness L51 of the end base portions 51 and the thickness L1 of the central base portion 52 are different from each other, a first helical protrusion 53 has different heights at different locations (e.g., the central base portion 52 and the end base portions 51). That is, the first helical protrusion 53 includes a first portion 53A at the central base portion 52 and a second portion 53B at each of the end base portions 52.

(3-3) According to the variations of the third illustrative embodiment, the same effects as those obtained by the third illustrative embodiment may be obtained.

5. Cleaning Roller 70 According to Fourth Illustrative Embodiment

Figure 11:
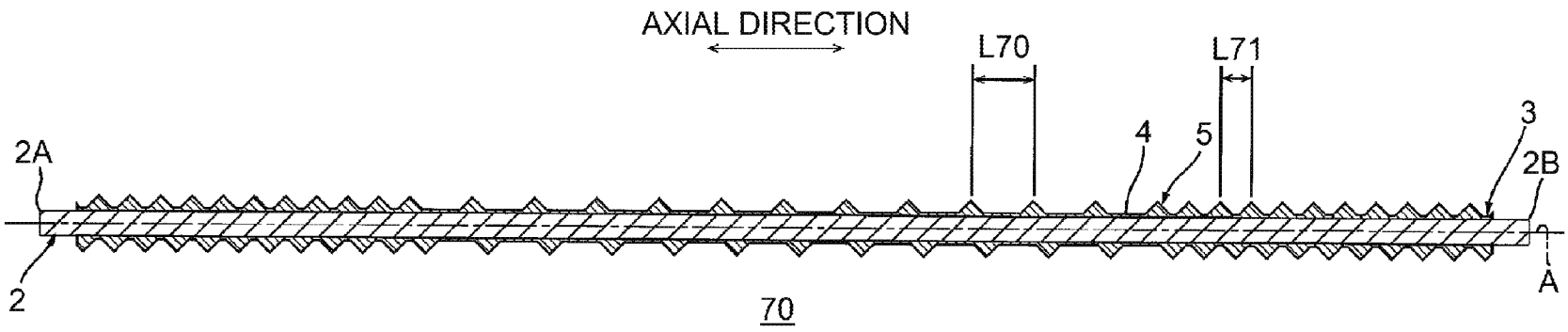
FIG. 11 is a cross-sectional view passing through the axis of the shaft depicting a cleaning roller in a fourth illustrative embodiment according to one or more aspects of the disclosure.

Referring to FIG. 11, a cleaning roller 70 according to a fourth illustrative embodiment will be described. An explanation will be given mainly for the parts different from the first illustrative embodiment, and an explanation will be omitted for the common parts by assigning the same or similar reference numerals thereto.

In the fourth illustrative embodiment, a pitch L70 (e.g., a ridge pitch) of a first helical protrusion 5 at a central portion of an elastic layer 3 is greater than a pitch L71 (e.g., a ridge pitch) of the first helical protrusion 5 at end portions of the elastic layer 3 while the cleaning roller 70 has the same or similar configuration to the cleaning roller 1 according to the first illustrative embodiment.

6. Cleaning Roller 80 According to Fifth Illustrative Embodiment

Figure 12:
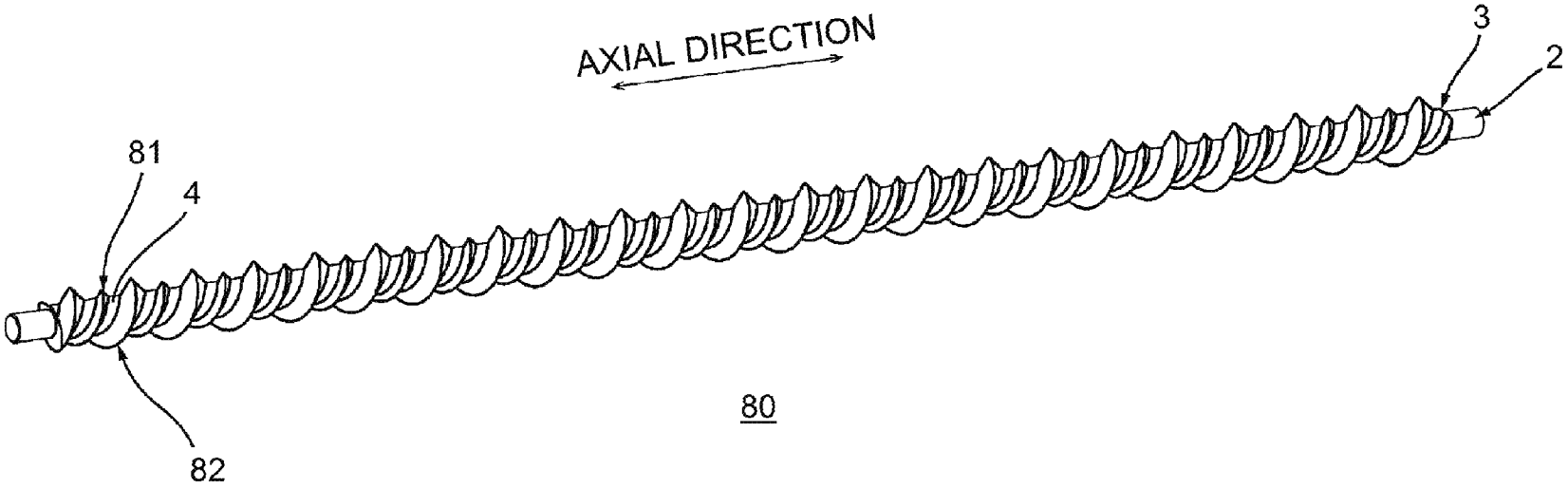
FIG. 12 is a perspective view depicting a cleaning roller in a fifth illustrative embodiment according to one or more aspects of the disclosure.

Referring to FIG. 12, a cleaning roller 80 according to a fifth illustrative embodiment will be described. An explanation will be given mainly for the parts different from the first illustrative embodiment, and an explanation will be omitted for the common parts by assigning the same or similar reference numerals thereto.

(1) First Helical Ridge 81 and Second Helical Protrusion 82

In the fifth illustrative embodiment, the cleaning roller 80 includes a first helical ridge 81 and a second helical protrusion 82, which constitute a double helix, while the cleaning roller 80 has the same or similar configuration to the cleaning roller 1 according to the first illustrative embodiment.

The first helical ridge 81 has a dimension smaller than the first helical protrusion 5 according to the first illustrative embodiment in the radial direction while the first helical ridge 81 has the same or similar configuration to the first helical protrusion 5 of the first illustrative embodiment.

Every turn of the second helical protrusion 82 is between turns of the first helical ridge 81 in the axial direction. The second helical protrusion 82 has the same or similar configuration to the first helical protrusion 5 of the first illustrative embodiment. That is, a ridge pitch of the second helical protrusion 82 may be constant. The ridge pitch the second helical protrusion 82 is equal to the distal end pitch of the first helical protrusion 81.

(2) Effects Obtained by Fifth Illustrative Embodiment

According to the fifth illustrative embodiment, the same effects as those obtained by the first illustrative embodiment may be obtained.

(3) Variation of Fifth Illustrative Embodiment

Figure 13:
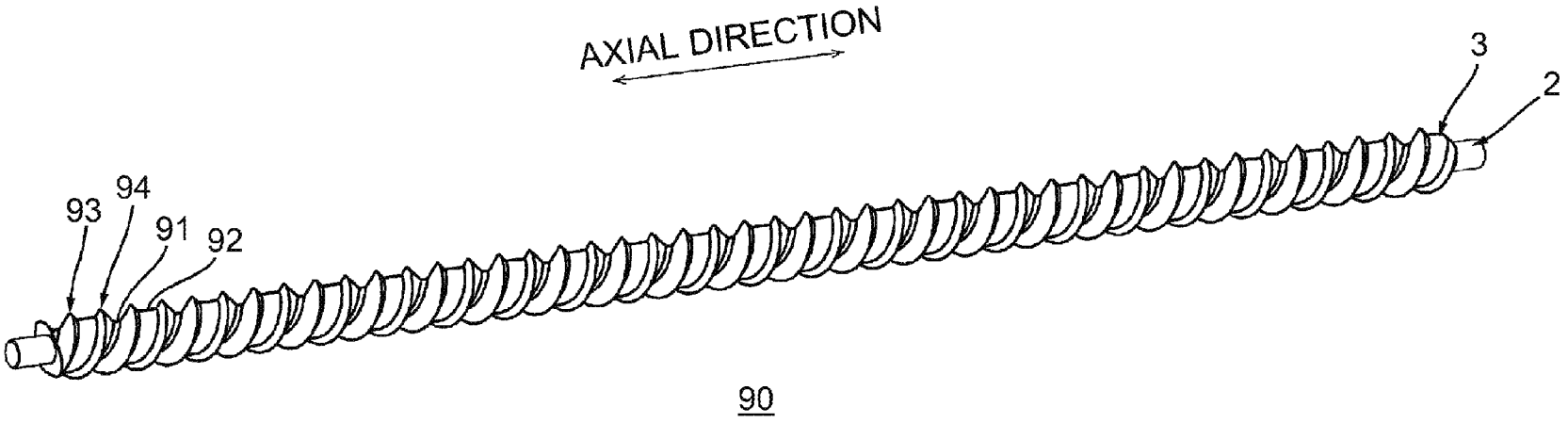
FIG. 13 is a perspective view depicting a cleaning roller in a variation of the fifth illustrative embodiment according to one or more aspects of the disclosure.

In a variation of the fifth illustrative embodiment, as depicted in FIG. 13, a cleaning roller 90 includes base portions 91 and 92 having respective different thicknesses similar to the second variation of the fourth illustrative embodiment. The base portions 91 and 92 are disposed alternately along the axial direction. With this configuration, the cleaning roller 90 includes a first helical protrusion 93 and a second helical ridge 94 having respective different shapes.

7. Sixth Illustrative Embodiment

Figure 14:
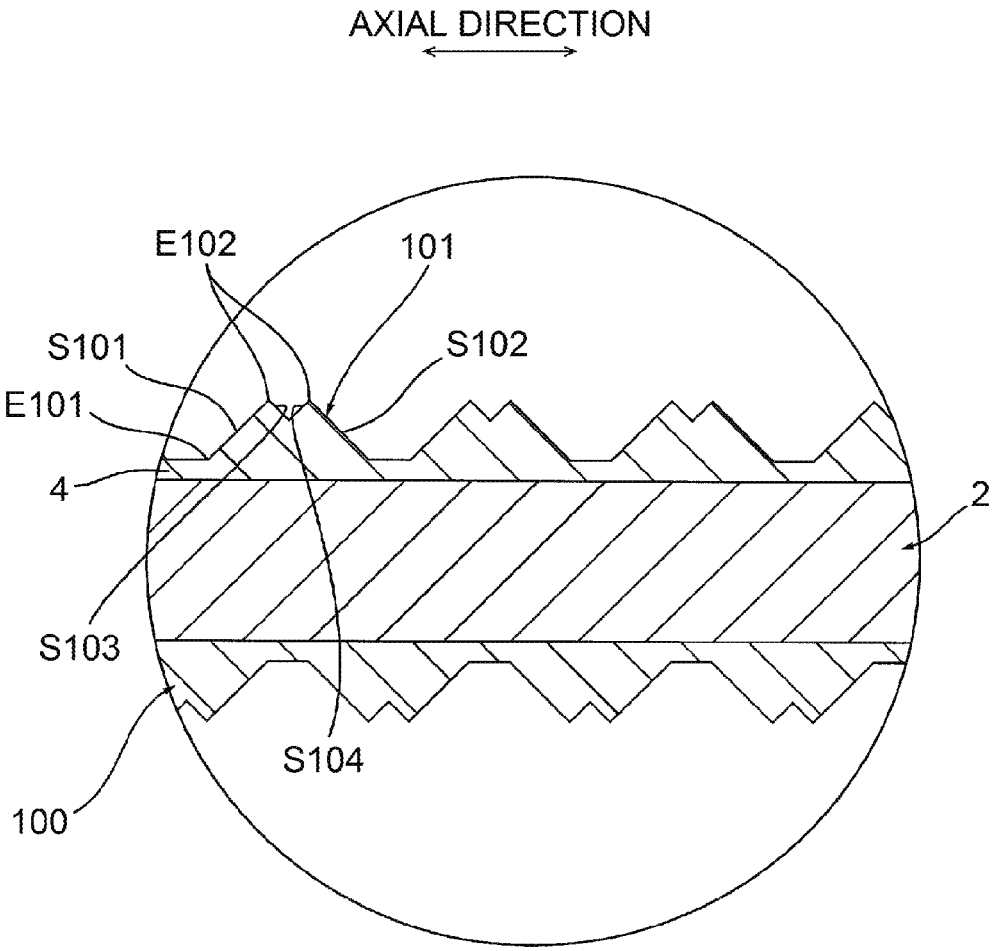
FIG. 14 is a partial enlarged view depicting a cleaning roller in a sixth illustrative embodiment according to one or more aspects of the disclosure.

Referring to FIG. 14, a cleaning roller 100 according to a sixth illustrative embodiment will be described. An explanation will be given mainly for the parts different from the first illustrative embodiment, and an explanation will be omitted for the common parts by assigning the same or similar reference numerals thereto.

In the sixth illustrative embodiment, the cleaning roller 100 includes a first helical protrusion 101 having a plurality of, for example, two, distal ends E102, which are apart from each other in the axial direction.

(1) First Helical Protrusion 101

The first helical protrusion 101 has a first surface S101, a second surface S102, a third surface S103, and a fourth surface S104 between a proximal end E101 and the distal end E102 pair.

The first surface S101 and the second surface S102 are opposite to each other relative to the distal end E102 pair in the axial direction. The first surface S101 and the second surface S102 are apart from each other in the axial direction. The first surface S101 is contiguous to one end of the proximal end E101 in the axial direction and one of the distal ends E102 in the axial direction. The second surface S102 is contiguous to the other end of the proximal end E101 in the axial direction and the other of the distal ends E102 in the axial direction. The first surface S101 is inclined toward the second surface S102 as the first surface S101 extends from the proximal end E101 to the one of the distal ends E102 in the radial direction. The second surface S102 is inclined toward the first surface S101 in the radial direction as the second surface S102 extends from the proximal end E101 to the other of the distal ends E102. That is, the first helical protrusion 101 is tapered toward the distal end E102 pair from the proximal end E101.

The third surface S103 is positioned between the first surface S101 and the second surface S102 in the axial direction. The third surface S103 is inclined toward the first surface S101 in the radial direction as the third surface S103 extends toward the one of the distal ends E102. The third surface S103 and the first surface S101 are connected with each other at the one of the distal ends E102 in the axial direction. Therefore, the one of the distal ends E102 in the axial direction may be a sharp edge. The third surface S103 is apart from the second surface S102 in the axial direction.

The fourth surface S104 is positioned between the third surface S103 and the second surface S102 in the axial direction. The fourth surface S104 is inclined toward the second surface S102 in the radial direction as the fourth surface S104 extends toward the other of the distal ends E102. The fourth surface S104 and the second surface S102 are connected with each other at the other of the distal ends E102 in the axial direction. Therefore, the other of the distal ends E102 in the axial direction may be a sharp edge.

(2) Effects Obtained by Sixth Illustrative Embodiment

According to the sixth illustrative embodiment, the same effects as those obtained by the first illustrative embodiment may be obtained.

8. Cleaning Roller 110 According to Seventh Illustrative Embodiment

Figure 15:
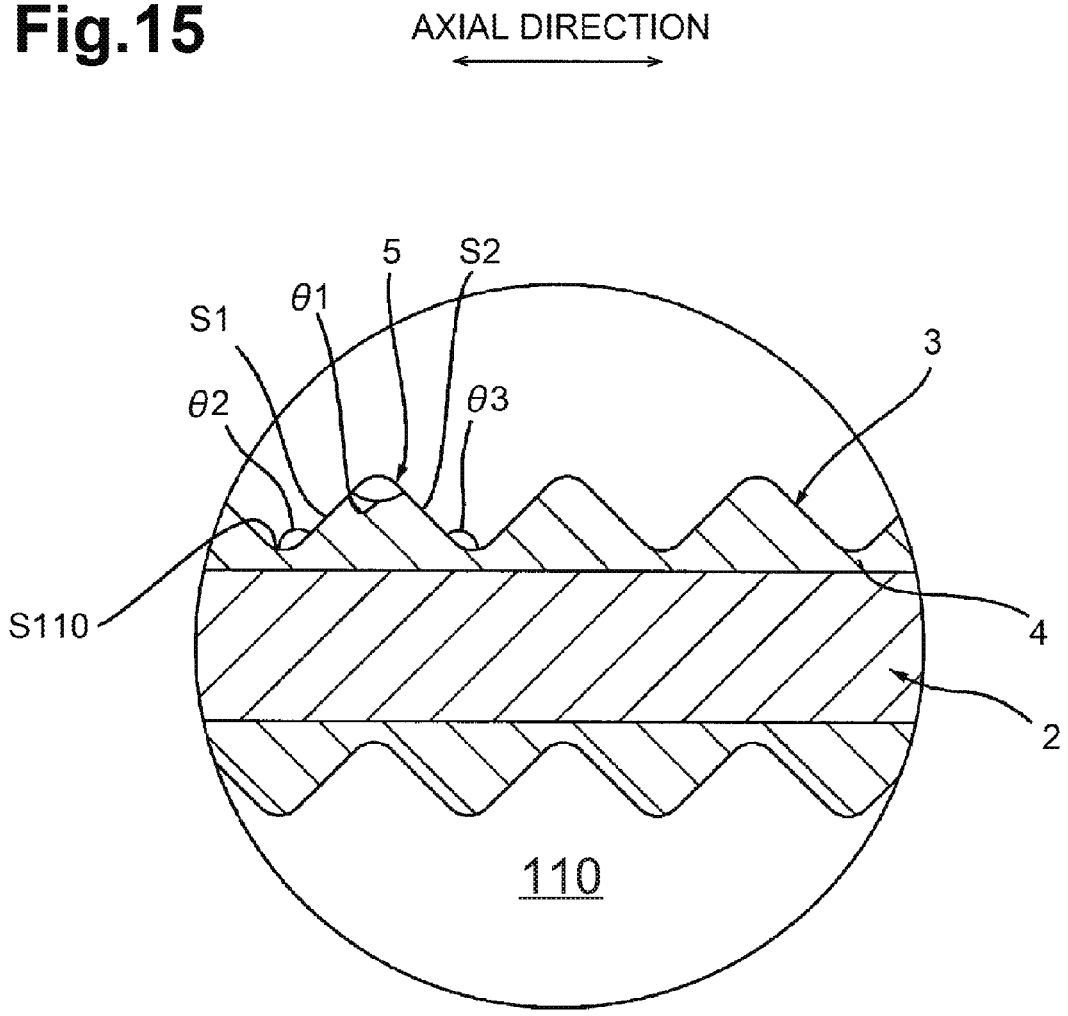
FIG. 15 is a partial enlarged view depicting a cleaning roller in a seventh illustrative embodiment according to one or more aspects of the disclosure.

Referring to FIG. 15, a cleaning roller 110 according to a seventh illustrative embodiment will be described. An explanation will be given mainly for the parts different from the first illustrative embodiment, and an explanation will be omitted for the common parts by assigning the same or similar reference numerals thereto.

In the seventh illustrative embodiment, in the cleaning roller 110, a first surface S1 and a second surface S2 of the first helical protrusion 5 are contiguous with an exterior surface of a base 4 and the exterior surface of the base 4 includes a curved surface S110. The curved surface S110 is contiguous with the first surface S1 and the second surface S2 of the first helical protrusion 5 and is curved toward the shaft 2.

9. Cleaning Roller 120 According to Eighth Illustrative Embodiment

Figure 16A:
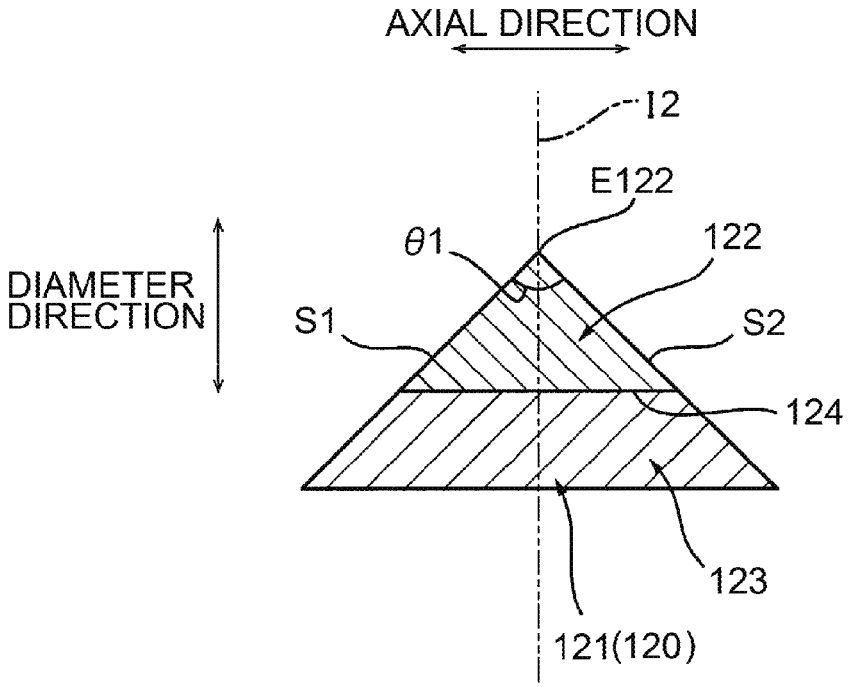
FIG. 16A is an explanatory diagram for explaining a first helical ridge of a cleaning roller in an eighth illustrative embodiment according to one or more aspects of the disclosure.

Referring to FIG. 16A, a cleaning roller 120 according to an eighth illustrative embodiment will be described. An explanation will be given mainly for the parts different from the first illustrative embodiment, and an explanation will be omitted for the common parts by assigning the same or similar reference numerals thereto.

In the eighth illustrative embodiment, the cleaning roller 120 includes a first helical protrusion 121 having a first portion 122 and a second portion 123 made of material different from material used for the first portion 122 while the cleaning roller 120 has the same or similar configuration to the cleaning roller 1 of the first illustrative embodiment.

(1) First Helical Protrusion 121

In the first helical protrusion 121, the first portion 122 is positioned closer to a helical ridge E122 than the second portion 123 in the radial direction. The first portion 122 includes the helical ridge E122. The second portion 123 is positioned farther from the helical ridge E122 than the first portion 122 in the radial direction. A boundary surface 124 between the first portion 122 and the second portion 123 extends in the axial direction.

The first portion 122 has a symmetrical shape relative to an imaginary plane I2. In the eighth illustrative embodiment, the imaginary plane I2 extends in the radial direction through a point on the helical ridge E122. The first portion 122 is made of material having a volumetric wear rate lower than the second portion 123. The first portion 122 may be made of, for example, silicon resin or urethane resin.

The second portion 123 has a symmetrical shape relative to the imaginary plane I2 in the axial direction. The second portion 123 is made of material having a restitution coefficient higher than the first portion 122. The second portion 123 may be a foam body made of, for example, urethane resin.

(2) Effects Obtained by Eighth Illustrative Embodiment

According to the cleaning roller 120 of the eighth illustrative embodiment, the first portion 122 may be made of material having the volumetric wear rate lower than the second portion 123, and the second portion 123 may be made of material having the restitution coefficient higher than the first portion 122.

Therefore, the helical ridge E122 may be made contact with the cleaning target by resilience of the second portion 123, and wearing of the helical ridge E122 may be reduced.

Accordingly, extraneous matter adhering to the cleaning target may be removed or scraped off therefrom by the helical ridge E122 with stability.

According to the eighth illustrative embodiment, the same effects as those obtained by the first illustrative embodiment may be obtained.

(3) Variation of Eighth Illustrative Embodiment

Figure 16B:
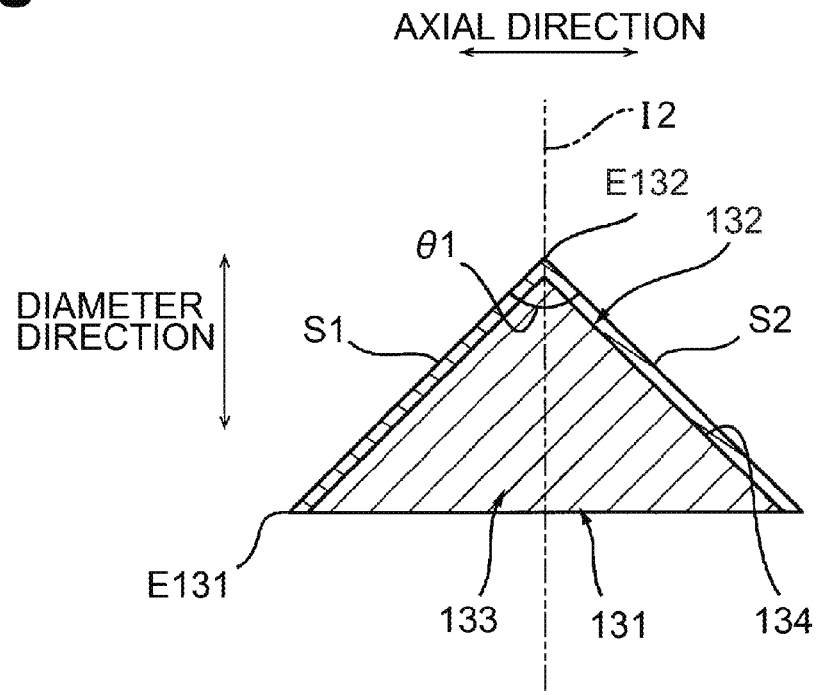
FIG. 16B is an explanatory diagram for explaining a first helical ridge of a cleaning roller in a variation of the eighth illustrative embodiment according to one or more aspects of the disclosure.

In one example, as depicted in FIG. 16B, a first helical protrusion 131 includes a first portion 132 and a second portion 133 covered by the first portion 132.

More specifically, for example, the first portion 132 covers a surface 134 of the second portion 133 between a proximal end E131 and a helical ridge E132. The first portion 132 also covers the second portion 133 at the helical ridge E132. Thus, the first portion 132 includes the helical ridge E132.

The first portion 132 and the second portion 133 have a symmetrical shape with respect to an imaginary plane I in the axial direction.

According to the variation of the eighth illustrative embodiment, the same effects as those obtained by the eighth illustrative embodiment may be obtained.

Although the disclosure has been described based on illustrative embodiments and variations, the illustrative embodiments of the disclosure facilitate the understanding of the disclosure and do not limit the disclosure. The disclosure may be changed or modified without departing from the spirit of the invention and the scope of the claims and includes the equivalents thereof.

What is claimed is:

1. A cleaning roller comprising:

a shaft including a rotational axis extending in an axial direction; and an elastic layer covering the shaft, the elastic layer including:

a base covering the shaft; and a first helical protrusion protruding from the base and including a first helical ridge, wherein the base includes a curved surface that is contiguous with a surface of the first helical protrusion and the curved surface is recessed toward the shaft.

2. The cleaning roller according to claim 1, wherein the first helical protrusion has a height of between 0.2 mm and 5 mm inclusive in a radial direction of the shaft.

3. The cleaning roller according to claim 2, wherein the first helical protrusion has the height of between 0.5 mm and 2.5 mm inclusive in the radial direction of the shaft.

4. The cleaning roller according to claim 1, wherein the rotational axis is provided on a first imaginary plane, wherein the first helical protrusion has a nonsymmetrical shape with respect to a second imaginary plane that intersects the first imaginary plane at a right angle to the rotational axis and that passes through the first helical ridge.

5. The cleaning roller according to claim 1, wherein the first helical protrusion includes a first portion and a second portion, the second portion having a different shape from a shape of the first portion and disposed both sides relative to the first portion in the axial direction.

6. The cleaning roller according to claim 5, wherein the second portion in the axial direction has a cross sectional area in the axial direction larger than a cross sectional area of the first portion.

7. The cleaning roller according to claim 5, wherein the second portion has a width in the axial direction greater than a width of the first portion in the axial direction.

8. The cleaning roller according to claim 1, wherein a pitch of the first helical ridge is constant.

9. The cleaning roller according to claim 8, wherein the elastic layer further includes a second helical ridge extending from the base and having a constant pitch, wherein the first helical ridge and the second helical ridge constitute a double helix, and wherein the first helical ridge and the second helical ridge have equal pitches.

10. The cleaning roller according to claim 1, wherein the elastic layer is made of foam rubber.

11. The cleaning roller according to claim 10, wherein the foam rubber is urethane.

12. A cleaning roller comprising:

a shaft including a rotational axis extending in an axial direction; and an elastic layer covering the shaft, the elastic layer including:

a base covering the shaft; and a first helical protrusion protruding from the base and including a first helical ridge, wherein the first helical protrusion includes a first portion and a second portion, the second portion having a different shape from a shape of the first portion and disposed both sides relative to the first portion in the axial direction, and wherein the second portion has a height in a radial direction greater than a height of the first portion in the radial direction.

13. A cleaning roller comprising:

a shaft including a rotational axis extending in an axial direction; and an elastic layer covering the shaft, the elastic layer including:

a base covering the shaft; and a first helical protrusion protruding from the base and including a first helical ridge, wherein the first helical protrusion includes a first portion and a second portion, the second portion having a different shape from a shape of the first portion and disposed both sides relative to the first portion in the axial direction, and wherein the base includes a first base portion and a second base portion, the second base having a thickness less than a thickness of the first base portion and disposed both sides relative to the first base portion in the axial direction.

14. A cleaning roller comprising:

a shaft including a rotational axis extending in an axial direction; and an elastic layer covering the shaft, the elastic layer including:

a base covering the shaft; and a first helical protrusion protruding from the base and including a first helical ridge, wherein the shaft extends along the axial direction, and wherein a pitch of the first helical ridge at a central portion of the elastic layer in the axial direction is greater than a pitch of the first helical ridge at an end portion of the elastic layer.

15. A cleaning roller comprising:

a shaft including a rotational axis extending in an axial direction; and an elastic layer covering the shaft, the elastic layer including:

a base covering the shaft; and a first helical protrusion protruding from the base and including a first helical ridge, wherein an angle formed by a surface of the base and a surface, which is contiguous to the base, of the first helical protrusion is an obtuse angle.

* * * * *